United States Patent [19]

Kern

[11] Patent Number: 4,865,525

[45] Date of Patent: Sep. 12, 1989

[54] METERING PUMP

[75] Inventor: Hans Kern, Vachendorf, Fed. Rep. of Germany

[73] Assignee: Grünbeck Wasseraufbereitung GMBH, Hochstadt, Fed. Rep. of Germany

[21] Appl. No.: 89,226

[22] Filed: Aug. 25, 1987

[30] Foreign Application Priority Data

Sep. 19, 1986 [DE] Fed. Rep. of Germany ..... 3631984

[51] Int. Cl.[4] ..... F04B 21/00

[52] U.S. Cl. ..... 417/307; 417/502

[58] Field of Search ..... 417/283, 502, 510, 442, 417/307

[56] References Cited

U.S. PATENT DOCUMENTS 1,931,691 10/1933 Goldberg ..... 417/502 X
2,308,974 1/1943 Harper ..... 417/510
3,680,985 8/1972 Ginsberg et al. ..... 417/502
4,236,881 12/1980 Pfleger ..... 417/502

FOREIGN PATENT DOCUMENTS 2803470 8/1979 Fed. Rep. of Germany ..... 417/505

*Primary Examiner*—Leonard E. Smith
*Attorney, Agent, or Firm*—Donald Brown

[57] ABSTRACT

A metering pump comprises a pump chamber with a diaphragm for delivering a metering agent to a metering point. The pump chamber is adapted to be connected with the metering agent tank through a suction conduit comprising a suction valve. Moreover, a return conduit comprising a head valve is provided.

For providing an automatic bleeding or ventilation of the metering pump and the possibility of using the pump also for metering aggressive media, the outlet of the pump chamber is adapted to be connected with the metering point through a second head valve. The outlet is connected with the return conduit and a bleed valve is provided in the return conduit.

10 Claims, 3 Drawing Sheets

METERING PUMP

BACKGROUND OF THE INVENTION

The invention relates to a metering pump for pumping a metering agent to a metering point. The invention relates in particular to a metering pump with a pump chamber comprising a diaphragm and being adapted to be connected with a metering agent tank through a suction conduit having a suction valve, and an automatic bleed system and a return conduit comprising a first head valve.

A metering pump of this kind is known from the German patent application No. 26 51 614.3. The diaphragm pump operates as predelivery pump. In addition there is provided a piston pump with the required piston packings operating as metering pump. When used for metering aggressive media, the piston packings have a limited service life such that such pumps are not suitable for the metering of aggressive media.

Metering pumps for aggressive media are known. However, they have the problem that air or gas gathers in the pump chamber and the output of the pump decreases until the pump is ventilated or bleeded by hand. This is in particular a drawback when outgasing media are used and metering agent tanks are exchanged.

OBJECTS OF THE INVENTION

It is an object of the invention to provide an improved metering pump, in which the above mentioned drawbacks are avoided.

It is a further object to provide a metering pump which is self-aspirating and self-bleeding. It is a still further object of the invention to provide a metering pump which is resistent against aggressive metering media.

SUMMARY OF THE INVENTION

In order to achieve the above mentioned objects the invention provides a metering pump comprising a pump chamber with a diaphragm for pumping metering agent to a metering point, a suction conduit comprising a suction valve and connecting said pump chamber with a metering agent tank, a return conduit comprising a first head valve and an automatic bleeding system, wherein said pump chamber is adapted to have an outlet thereof connected with said metering point through a second head valve, said outlet being connected with said return conduit, and wherein bleeding means are provided in said return conduit.

BRIEF DESCRIPTION OF THE DRAWINGS

Further advantages, features and objects of the invention will stand out from the following description of examplary embodiments with reference to the drawings, wherein.

DESCRIPTION OF PREFERRED EMBODIMENTS

Figure 1:
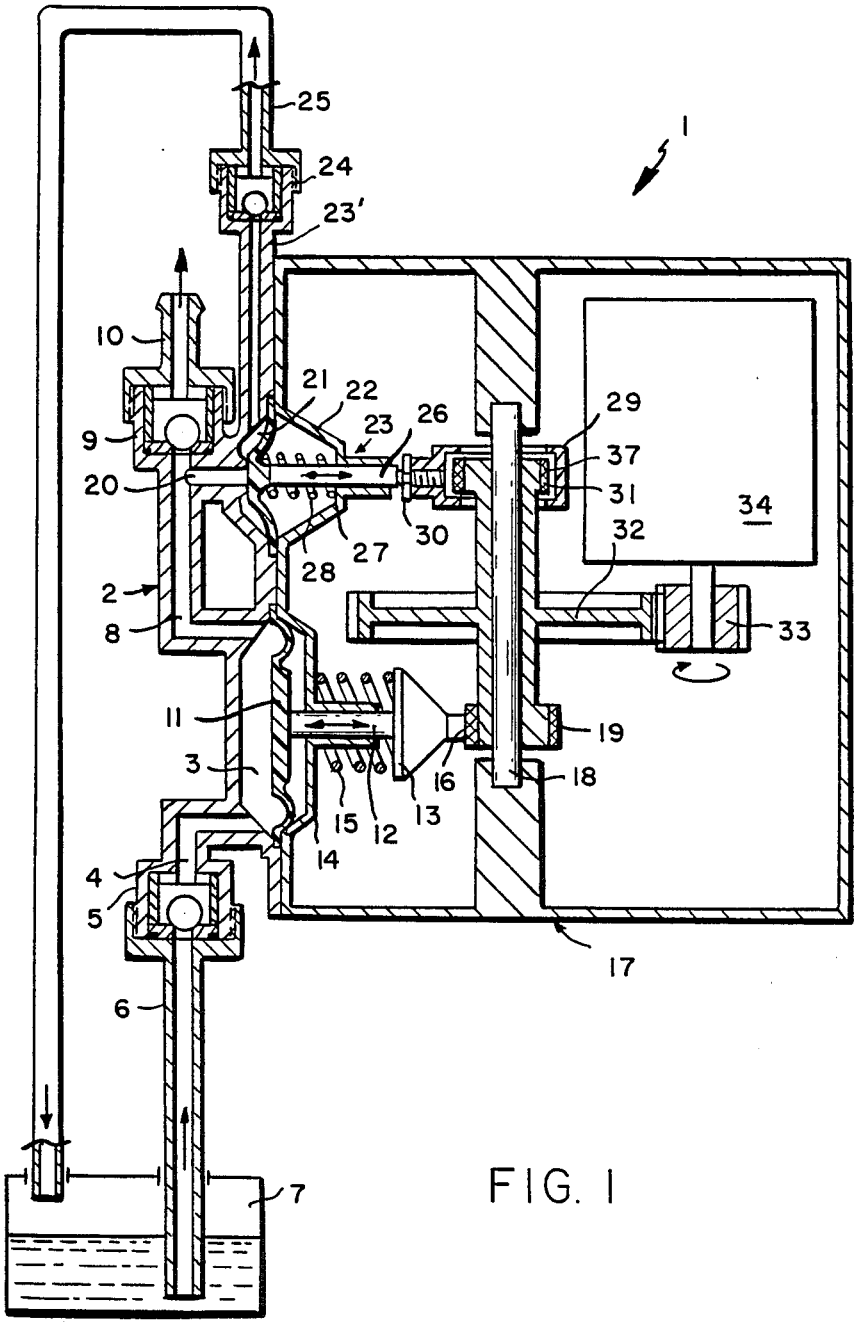
FIG. 1 is a sectional view of a metering pump according to the invention.

The metering pump 1 shown in FIG. 1 comprises a pump head 2. The pump head comprises a pump chamber 3 extending in vertical direction. A suction channel

4 which is connected with a suction conduit 6 through a suction valve 5, follows that end of the pump chamber which is the lower end when seen in vertical direction. The suction conduit 6 leads into a metering agent tank 7.

A riser pipe 8 opens into that end of the pump chamber 3 which is the upper end as seen in vertical direction. The upper end of the riser pipe 8 leads through a head valve 9 to a connection 10 which is adapted to be connected with a metering point.

A metering diaphragm 11 is clamped within the pump chamber in the manner shown in FIG. 1 and has the rear side thereof rigidly connected with a tappet 12 which comprises a stop 13. A compression spring 15 biasing the diaphragm 11 into the suction position is provided between the stop and a fixed frame plate 14.

A shaft 18 carrying a metering excenter 19 is supported in the pump housing 17 which is connected with the pump head 2 in the manner shown in FIG. 1. The end 16 of the tappet abuts the metering excenter 19 by being biased by the compression spring 15.

A cross-bore 20 leads into the riser pipe 8 as close as possible to and possibly right at the upper end of the riser pipe, i.e. right before the head valve 9. The cross-bore leads into the valve chamber 21 of a bleed or ventilation valve which is formed by a diaphragm pump 22. A valve face 23 is formed at the end of the cross-bore 20. A riser pipe 23', which is connected with a return conduit 25 through a head valve 24, extends from the vertically upper region of the valve chamber 21. In the described embodiment the return conduit leads back into the metering agent tank 7.

The diaphragm has the side thereof which is opposite to the valve chamber rigidly connected with a tappet 26. A compression spring 28 is provided between the rear side of the diaphragm and a wall portion 27 of the housing and biased such that the diaphragm is for the moment held in the closed position shown in FIG. 1.

The end of the tappet which is turned away from the diaphragm is connected with a yoke 29 in a manner to be adjustable by means of a counter-nut 30.

A second excenter 31 sitting on the shaft 18 operates within the yoke 29. In the embodiment shown in FIG. 1 both excenters are rigidly connected with a gear wheel 32 which is drivably connected with the pinion 33 of a drive motor 34.

The second excenter 31 is designed such that the tappet 26 is moved within the desired angular region such that the diaphragm 35 of the diaphragm pump performs a suction stroke against the compression spring 28.

Figure 2:
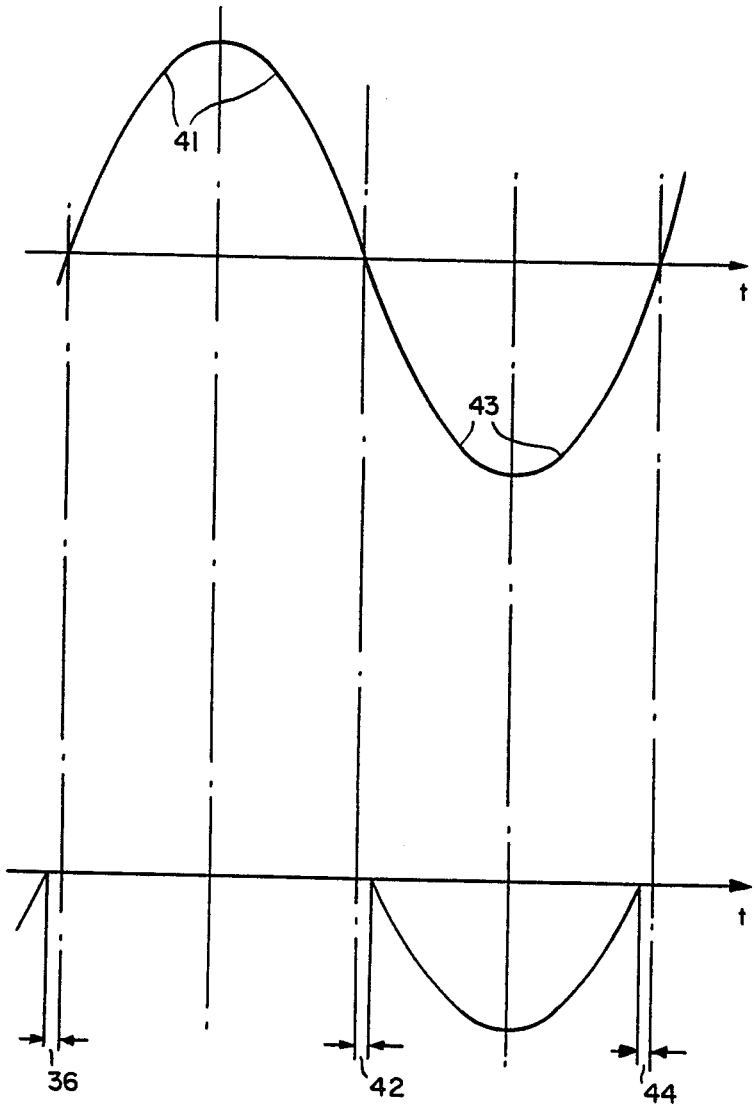
FIG. 2 represents the strokes of the pump parts as a function of time.

The two excenters 19 and 31 are angularly displaced or offset with respect to each other such that the cycles follow as shown in FIG. 2. As may be seen from this Figure, the valve formed by the diaphragm pump 22 closes a short period 36 before the metering diaphragm 11 performs the pressure stroke. Once the metering stroke has been performed, the bleed valve formed by the diaphragm pump opens a short period 42 after the end of the metering stroke. The suction stroke 43 of the diaphragm 11 has already started during this period. The bleed valve closes by bringing the diaphragm 35 into the touch-down position shown in FIG. 1 a short period 44 before the end of the suction stroke. It is guaranteed in this manner that no gas may enter the system during the pressure stroke.

As may be seen from FIG. 1, a distance or gap 37 exists between the yoke 29 and the second excenter 31. By means of this gap 37 of the excenter movement is changed into a cam movement, wherein the compression spring 28 is charged with the forward movement and the closing force. The closing force of the compression spring 28 may be designed such that the compression spring yields at a predetermined pressure within the pump head, whereby the bleed valve additionally operates as relief valve.

In another embodiment, the diaphragm pump 22 performs a suction stroke only each (n−m) stroke, wherein n denotes the number of strokes of the metering diaphragm 11 and wherein m denotes a natural number.

Figure 3:
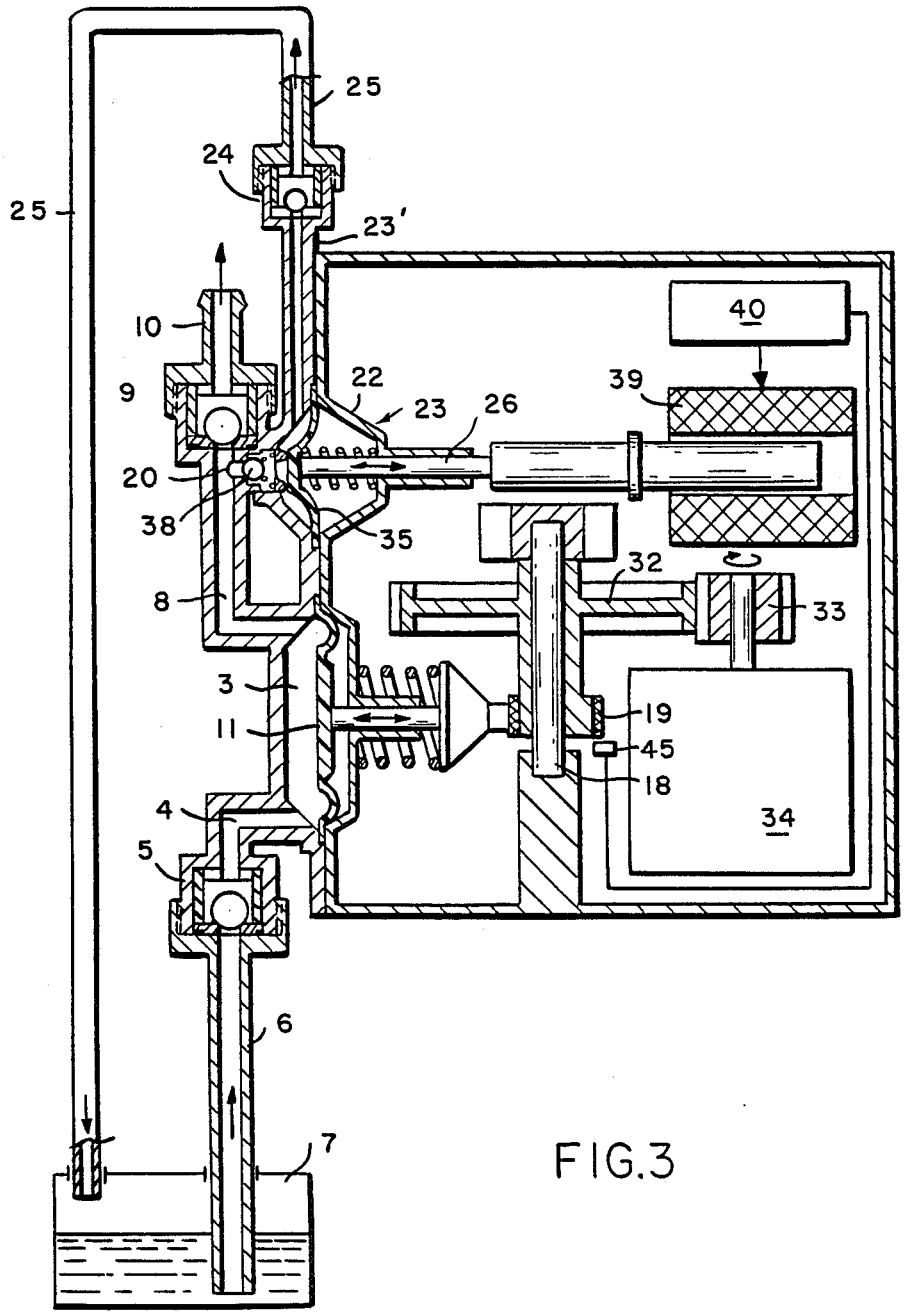
FIG. 3 is a representation of a modified embodiment, the representation corresponding to that of FIG. 1.

The embodiment shown in FIG. 3 comprises all features shown in FIG. 1. Additionally a check valve 38 is provided between the riser pipe 8 and the bleed valve formed by the diaphragm pump 22. The check valve accelerates the ventilation or bleeding.

Moreover, the tappet 26 is retracted into the suction position by a separately driven lifting magnet 39 rather than by the motor 34. The lifting magnet 39 is excited by a control unit 40. A sensor 45 is provided which detects the rotational position of the metreing excenter 19 and supplies an output signal representative of this rotational position to the control unit 40 in order to ensure the synchronization of the metering stroke of the diaphragm 35 in the above described manner with the diaphragm 11.

The control unit 40 is designed such that the diaphragm 35 does not follow every stroke of the diaphragm 11 but remains in the closed position shown in FIG. 3 for a predetermined number of operating cycles of the diaphragm 11. It is achieved in this manner that the use of the diaphragm 35 is considerably reduced without impairing the pumping power of the pump. The control unit 40 can be adjusted such that the number of the strokes which are skipped by the diaphragm 35 can be adjusted as a function of the medium to be pumped and the outgassing tendency thereof.

Although the invention has been described with reference to specific example embodiments, it is to be understood that it is intended to cover all modifications and equivalents within the scope of the appended claims.

What is claimed is:

1. A metering pump comprising a first diaphragm pump comprising a pump chamber and a diaphragm for pumping a metering agent to a metering point, a suction conduit comprising a suction valve and connecting said pump chamber with a metering agent tank, a return conduit comprising a first head valve and an automatic bleeding system, wherein said pump chamber is adapted to have an outlet thereof connected with said metering point through a second head valve, said outlet being connected with said return conduit, wherein said bleeding system is in the form of a second disphragm pump provided in said return conduit, said two pumps being designed to be driven by a common drive and wherein said first diaphragm pump performs a suction stroke each (n−m)th stroke, and wherein n denotes the number of strokes of the pump chamber diaphragm and m is a natural number.

2. A metering pump comprising a pump chamber with a diaphragm for pumping metering agent to a metering point, a suction conduit comprising a suction valve and connecting said pump chamber with the metering agent tank, a return conduit comprising a first head valve and an automatic bleeding system wherein said pump chamber is adapted to have an outlet thereof connected with said metering point through a second head valve, said outlet being connected with said return conduit, and wherein said bleeding means are provided in said return conduit, said bleeding means being in the form of a second diaphragm pump.

3. A metering pump comprising a first pump embodying a pump chamber with a diaphragm for pumping metering agent to a metering point, a suction conduit comprising a suction valve and connecting said pump chamber with a metering agent tank, a return conduit comprising a first head valve and an automatic bleeding system wherein said pump chamber is adapted to have an outlet thereof connected with said metering point through a second head valve, said outlet being connected with said return conduit and wherein said bleeding means is in the form of a diaphragm pump provided in said return conduit and wherein the two diaphragm pumps are designed to be driven by a common drive.

4. A metering pump comprising a first pump provided with a diaphragm for pumping metering agent to a metering point, a suction conduit comprising a suction valve and connecting said first pump chamber with a metering agent tank, a return conduit comprising a first head valve and a bleeding valve, wherein said first pump chamber is adapted to have an outlet thereof connected with said metering point through a second head valve, said outlet being connected with said return conduit, and wherein actuating means are provided for actuating said bleeding valve in synchronization with said first pump to close said bleeding valve a short period before the metering pump performs a pressure stroke and to hold said bleeding valve closed during the pressure stroke of the pump.

5. A metering pump comprising a first pump provided with a diaphragm for pumping metering agent to a metering point, a suction conduit comprising a suction valve and connecting said first pump chamber with a metering agent tank, a return conduit comprising a first head valve and a bleeding valve, wherein said first pump chamber is adapted to have an outlet thereof connected wtih said metering point through a second head valve, said outlet being connected with said return conduit, and wherein actuating means are provided for actuating said bleeding valve in synchronization with said first pump to close said bleeding valve during the pressure stroke of the pump and wherein the bleeding valve is in the form of a diaphragm pump.

6. A metering pump according to claim 5, wherein the bleeding valve closes by bringing the diaphragm into the closed position.

7. A metering pump comprising a first pump for pumping a metering agent to a metering point, a suction conduit comprising a suction valve and connecting said first pump with a metering agent tank, a return conduit comprising a first head valve and an automatic bleeding system wherein said first pump is adapted to have an outlet thereof connected to said metering point through a second head valve, said outlet being connected with said return conduit and wherein said bleeding means are provided in said return conduit, said bleeding means being in the form of a second pump.

8. A metering pump according to claim 7, wherein said first and second pumps are designed to be driven by a common drive.

9. A metering pump according to claim 8 comprising a riser pipe being disposed between said pump chambers and said second head valve.

10. The metering pump according to claim 9, wherein said return conduit leads into said riser pipe as as it leads into a riser as close as possible to the upper end of said riser pipe.

* * * * *